US005429147A

United States Patent [19]

Barrington

[11] Patent Number: 5,429,147

[45] Date of Patent: Jul. 4, 1995

[54] DETACHABLE COVER UMBRELLA

[76] Inventor: Joan Barrington, 10 Roslyn Avenue, Ottawa, Ontario, Canada, K1S 4W1

[21] Appl. No.: 136,249

[22] Filed: Oct. 15, 1993

[51] Int. Cl.[6] ..... A45B 25/18

[52] U.S. Cl. ..... 135/33.5; 135/33.41

[58] Field of Search ..... 135/33.2, 33.4, 33.41, 135/33.52

[56] References Cited

U.S. PATENT DOCUMENTS

| | | | |
|---|---|---|---|
| 2,453,270 | 11/1948 | Russell | 135/33.4 |
| 2,920,634 | 1/1960 | Malin . | |
| 3,042,056 | 7/1962 | Todorovic | 135/33.2 |
| 3,863,660 | 2/1975 | Glaeser | 135/33.2 |
| 4,794,939 | 1/1989 | Okuda | 135/33.2 |
| 4,979,535 | 12/1990 | Sadowski et al. . | |
| 5,065,779 | 11/1991 | Johnson . | |
| 5,226,438 | 7/1993 | Dubinsky | 135 X/33.2 |

*Primary Examiner*—Carl D. Friedman
*Assistant Examiner*—Beth A. Aubrey
*Attorney, Agent, or Firm*—Kent & Edgar

[57] ABSTRACT

In accordance with the present invention an umbrella with a detachable cover is provided, of the type comprising a shaft, a handle at one end, ribs hingedly secured to the other end and means associated with the shaft to move the ribs between open and closed position, with the cover supported on the ribs. The improvement according to the present invention is characterized in that a flexible strip extends about the ribs secured to their free ends, and attachment means are secured to portions of the ribs and the flexible strip, and corresponding attachment means are secured to corresponding portions of the cover so that the cover is releasably attachable to the ribs.

11 Claims, 2 Drawing Sheets

DETACHABLE COVER UMBRELLA

BACKGROUND OF THE INVENTION

The present invention relates to detachable umbrella covers.

Umbrellas with removable or replaceable covers provide obvious advantages and uses. They enable a person to fashion coordinate with that person's wardrobe. They permit adaption of the umbrella to different uses: for example a dark cover which is rain proof and water proof may be replaced by a lighter material which is porous for the wind, to act as a sunshade.

U.S. Pat. No. 4,979,535 of Sadowski et al issued Dec. 25, 1990 teaches an umbrella having a fabric cover equipped with rings individually secured at spaced points about its periphery, and co-operating, grooved connectors at the end of each rib. A plurality of Velcro (trade-mark) flaps are secured to the underside of the fabric for wrapping about the ribs. In the center of the cover a hole is provided through which the top end of the umbrella shaft passes, the cover being frictionally held on the ribs, in this area, by means of a ring which is releasably retained in a groove about the shaft immediately adjacent the ribs. In this way both the periphery and central parts of the fabric are detachably secured to the ribs of the umbrella.

Other patents of general background interest are U.S. Pat. No. 2,920,634 of Malin issued Jan. 12, 1960; U.S. Pat. No. 5,065,779 of Johnson et al issued Nov. 19, 1991 and U.S. Pat. No. 5,226,438 of Dubinsky issued Jul. 13, 1993.

It is an object of the present invention to provide an alternative construction of umbrella with detachable cover which will facilitate detaching and engaging a cover to the frame and ribs of an umbrella.

SUMMARY OF THE INVENTION

In accordance with the present invention an umbrella with a detachable cover is provided, of the type comprising a shaft, a handle at one end, ribs hingedly secured to the other end and means associated with the shaft to move the ribs between open and closed positions, while a cover is supported on the ribs. The improvement according to the present invention is characterized in that a flexible strip extends about the ribs secured to their free ends, and attachment means are secured to portions of the ribs and the flexible strip. Corresponding attachment means are secured to corresponding portions of the underside of the cover so that the cover is releasably attachable to the ribs. It is preferred that the fastener means be Velcro. To secure the fabric to the ribs at the upper end of the shaft, a cap is provided which preferably snap fits or is threadedly engaged to the end of the shaft to cover adjacent portions of the fabric.

The umbrella in accordance with the present invention is both easy to construct and operate. That the fastener means, such as Velcro, on the flexible strip about the ribs and at spaced locations on the ribs, readily engages and dis-engages with the cooperating attachment means on the under side of the fabric umbrella cover.

BRIEF DESCRIPTION OF THE DRAWINGS

These and other objects and advantages of the invention will become apparent upon reading the following detailed description and upon referring to the drawings in which.

Figure 1:
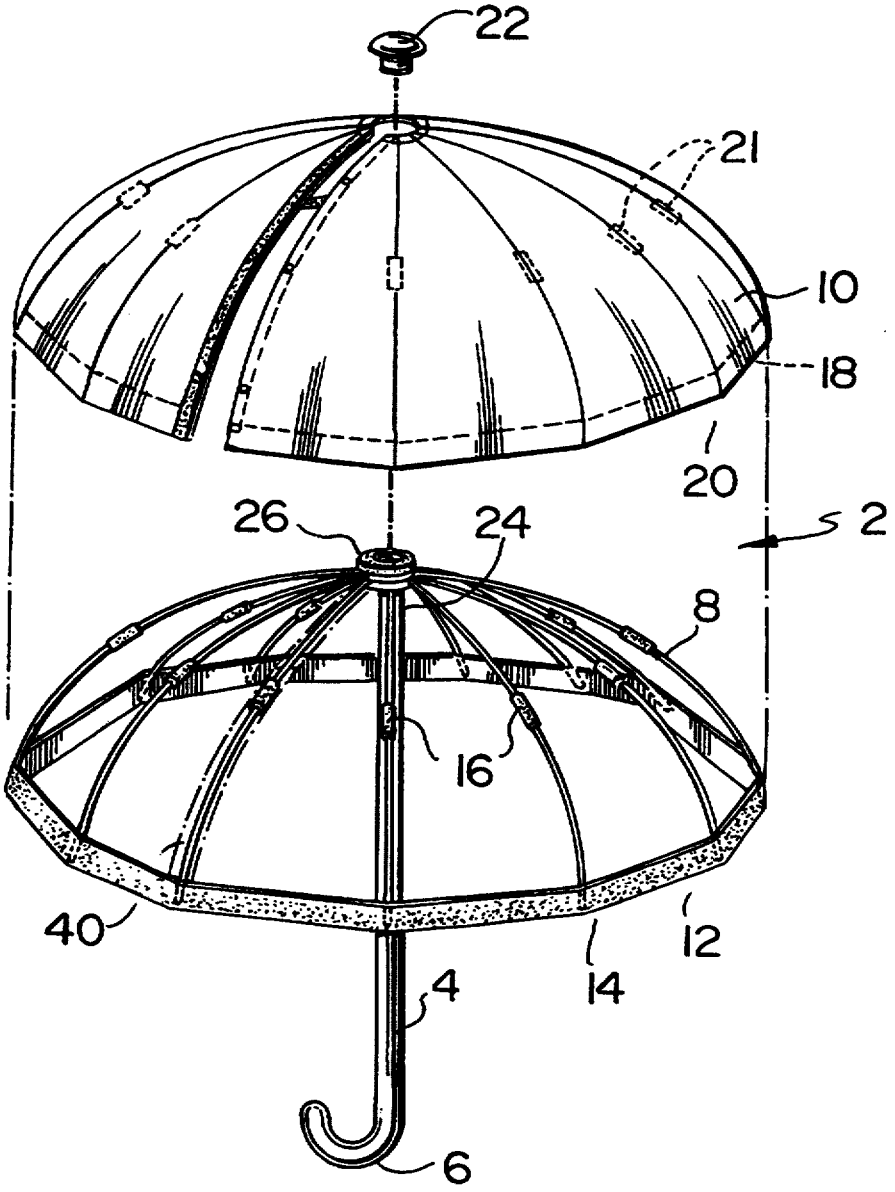
FIG. 1 is a perspective, exploded view of an example embodiment of umbrella in accordance with the present invention, showing the cover and gap in detached position.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Figure 2:
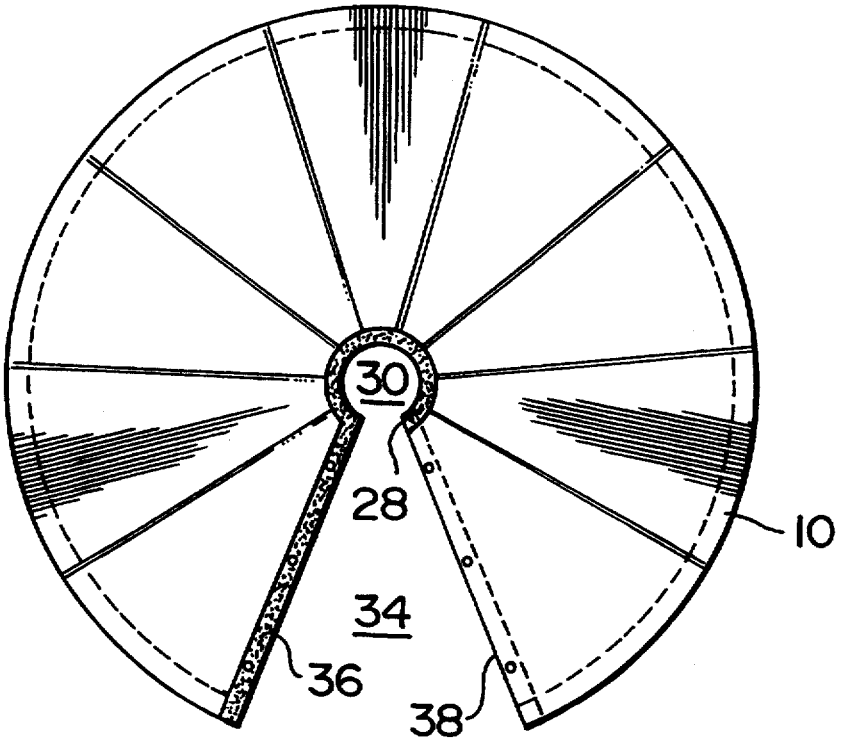
FIG. 2 is a plan view of an example embodiment of umbrella cover in accordance with the present invention.
Figure 3:
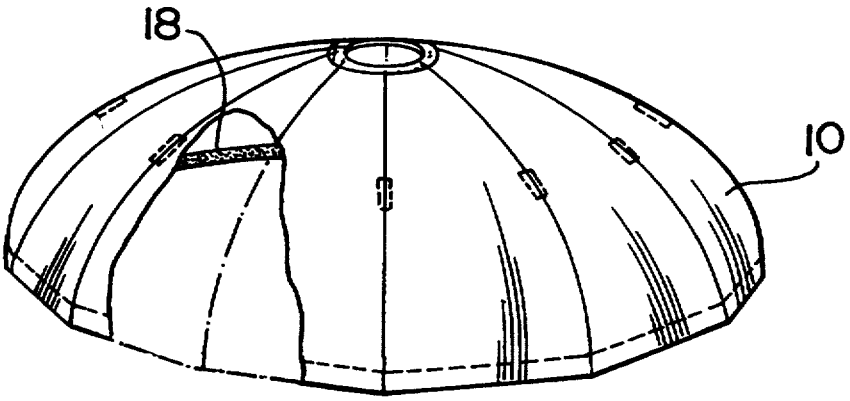
FIG. 3 is a perspective view of an alternative embodiment of umbrella cover in accordance with the present invention.

Turning to FIG. 1 there is shown an umbrella 2 in accordance with the present invention, comprising a shaft 4, a handle 6 at one end of the shaft and ribs 8 hingedly secured to the shaft near its other end. Appropriate conventional means (not illustrated) are provided to move the ribs between open and closed positions. A cover 10, alternative shapes of which are illustrated in FIGS. 2 and 3, is constructed so as to be releasably supported on ribs 8.

More particularly, a flexible strip 12 which is preferably either the hook or pile half of a Velcro (trade-mark) fastener, extends about the ribs 8 and is secured to their free ends 14 as illustrated. As well, similar attachment means 16 of Velcro or the like are attached at appropriate spaced locations along the ribs 8. Co-operating attachment means, such as for example the pile half of a Velcro fastener 18, are attached to corresponding portions along the periphery 20 of fabric cover 10 on its underneath or bottom side, so that, when the cover 10 is in position on ribs 8, the respective attachment means on the strip 12 and periphery 20 of cover 10 are mateably, releasably received.

Similarly secured to appropriate locations on the underneath part of cover 10 are attachment means 21 such as Velcro fasteners, to co-operate with and become releasably attached to the attachment means 16 on ribs 8.

A cap 22 is, for example, threadably attached to the upper end 24 of shaft 4. This cap 22 is preferably of rubber or other pliable material so that its edges can bear down on adjacent portions of cover 10 to hold them on the ribs. Attachment means 26 such as for example Velcro fasteners, may also be secured at an appropriate location near the top of shaft 4 to releasably receive corresponding attachment means 28 (FIG. 2) secured at an appropriate location about the periphery of aperture 30 provided in the center of cover 10. Since the edges of cap 22 are pliable, they can be lifted out of the way to facilitate securing the central portion of the cover to the shaft.

In the alternative embodiment of cover illustrated in FIG. 2, the convex upper surface/convex lower surface of cover 10 is achieved by removing a segment of material, from a circular piece of material as illustrated, to provide a space 34, and providing appropriate attachment means such as snaps or Velcro along confronting radial edges 36 and 38. The appropriate shape of the cover 10 is achieved when these opposite edges are brought together and secured. With this embodiment, Velcro or other attachment means are preferably provided along an entire rib 40, over which the joined radial edges 36 and 38 of cover 10 may be seated.

In the embodiment of cover illustrated in FIG. 3, the cover itself is preformed to the appropriate convex/-concave shape for the umbrella frame, as illustrated.

It will be understood that a relatively simple, inexpensive but effective construction of detachable cover umbrella is provided in accordance with the present invention. The use of a Velcro (or other) securing strip about the ends of ribs 8, to cooperate with corresponding Velcro or other attachment means about the periphery of the cover, in combination with Velcro or other appropriate co-operating fastener means at spaced locations on the ribs, mating directly with corresponding co-operating attachment means on the underneath side of the cover, permits a simple attachment and detachment of the cover to or from the ribs.

Thus it is apparent that there has been provided in accordance with the invention a detachable cover umbrella that fully satisfies the objects, aims and advantages set forth above. While the invention has been described in conjunction with a specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In an umbrella comprising a shaft, a handle at one end, ribs hingedly secured to the other end, means associated with the shaft to move the ribs between open and closed positions, and a cover supported on the ribs, the improvement characterized in that a flexible strip extends about the ribs secured to their free ends, and attachment means are secured to portions of the ribs and the flexible strip, and corresponding attachment means are secured to corresponding portions of the underside of the cover so that the cover is releasably attachable to the ribs.

2. An umbrella according to claim 1 wherein the attachment means comprise a hook and pile fastener means.

3. An umbrella according to claim 1 wherein attachment means are secured along the entire length of one of the ribs, and the fabric cover is of circular shape with a segment and the center removed, and corresponding attachment means are secured to radially extending edges of the cover for attachment to each other and to the attachment means secured along said one rib, to draw the cover into convex shape for positioning over the ribs.

4. An umbrella according to claim 3 further comprising a cap for releasably securing to means at the end of the shaft opposite from the handle, over the ribs and cover, to assist in securing the cover on the ribs.

5. An umbrella according to claim 4 wherein attachment means are provided about the periphery of the aperture formed in the center of the fabric and corresponding attachment means are provided on corresponding portions of the shaft.

6. An umbrella according to claim 5 wherein the fabric cover is of circular, convex shape for positioning on the ribs, with a circular, central aperture for receiving therein the end of the shaft opposite from the handle.

7. An umbrella according to claim 1 further comprising a cap for releasably securing to means at the end of the shaft opposite from the handle, over the ribs and cover, to assist in securing the cover on the ribs.

8. A fabric cover according to claim 7 wherein the cap and corresponding end of the shaft are provided with co-operating thread means for releasably threadably attaching the cap to that end of the shaft.

9. An umbrella according to claim 1 wherein the fabric cover is of circular, convex Shape for positioning on the ribs, with a circular, central aperture for receiving therein the end of the shaft opposite from the handle.

10. An umbrella according to claim 9 further comprising a cap for releasably securing to the end of the shaft opposite from the handle, over the ribs and cover, to assist in securing the cover on the ribs.

11. An umbrella cover according to claim 10 wherein the attachment means for the fabric comprises one component of a hook and pile fastener means adapted to co-operate with the other component of said fastener means on the umbrella ribs.

* * * * *